US007310837B2

(12) United States Patent
Reynolds et al.

(10) Patent No.: US 7,310,837 B2
(45) Date of Patent: Dec. 25, 2007

(54) BATHTUB/SHOWER SEAT

(75) Inventors: Elinor L. Reynolds, Seattle, WA (US); Donald S. White, deceased, late of Seattle, WA (US); by Elinor L. Reynolds, legal representative, Seattle, WA (US); Kurt A. Jenkins, Seattle, WA (US)

(73) Assignee: Ellie Situpon, Inc., Seattle, WA (US)

( * ) Notice: Subject to any disclaimer, the term of this patent is extended or adjusted under 35 U.S.C. 154(b) by 132 days.

(21) Appl. No.: 10/959,481

(22) Filed: Oct. 5, 2004

(65) Prior Publication Data

US 2005/0076431 A1 Apr. 14, 2005

Related U.S. Application Data

(60) Provisional application No. 60/509,323, filed on Oct. 6, 2003.

(51) Int. Cl.
*A47K 3/022* (2006.01)
*A47K 3/12* (2006.01)

(52) U.S. Cl. ..... 4/579

(58) Field of Classification Search ..... 4/577.1, 4/578.1, 579

See application file for complete search history.

(56) References Cited

U.S. PATENT DOCUMENTS 1,805,622 A 5/1931 Goodwin
3,289,217 A * 12/1966 Glover ..... 4/562.1
3,875,597 A * 4/1975 McGaffin et al. ..... 4/578.1
4,472,844 A * 9/1984 Mace ..... 4/579
5,086,521 A * 2/1992 Stewart ..... 4/234
6,115,857 A * 9/2000 Bidegain ..... 4/574.1
6,662,385 B1 * 12/2003 Bayne ..... 4/557

FOREIGN PATENT DOCUMENTS

| | | |
|---|---|---|
| GB | 1399752 | 7/1975 |
| GB | 2364907 | 2/2001 |
| JP | 2002325694 | 12/2002 |

OTHER PUBLICATIONS

English language abstract of Japanese Patent No. 2002325694.

* cited by examiner

*Primary Examiner*—Charles E. Phillips
(74) *Attorney, Agent, or Firm*—Marger Johnson & McCollom

(57) ABSTRACT

Disclosed is a seat for use around the bathtub area. Specifically, the seat is formed so that it can fit around a side wall of a bathtub. Because there are many standard sizes of bathtubs, some embodiments of the invention include an adjustment mechanism so that the seat can be adjusted to securely attach to the side wall of most sizes of bathtubs. Other embodiments of the invention provide for a seat that can be used within the bathtub itself. Further embodiments are implemented that can sit securely on a bathtub on which a door rail is also attached.

7 Claims, 4 Drawing Sheets

BATHTUB/SHOWER SEAT

CROSS REFERENCE TO RELATED APPLICATIONS

This application claims priority from U.S. Provisional application 60/509,323, filed Oct. 6, 2003, which is incorporated herein by reference in its entirety.

TECHNICAL FIELD

This disclosure is directed toward a device used in a bathroom, and, more specifically, to a portable seat that can be placed on the side of the bathtub or shower to provide support to a user.

BACKGROUND

Generally bathtubs are commonly used for their intended purpose—to sit in while bathing or to stand in while showering. There is, however, a segment of the population that uses the bathtub and tub area for activities other than typical bathing and showering. Some of these other activities include giving small children baths, grooming pets, and personal cleansing where it is desired that the whole body not be within the bathtub. For instance, some people cannot or should not fully sit in a bathtub, but would still like to clean their feet, legs and/or other parts of their body, such as body creases.

Additionally, those with limited physical conditions such as the elderly oftentimes need a device in addition to that provided in a standard bathroom to assist them in their use of the bathtub or shower. One such device is a handrail that is firmly attached to a wall above the bathtub that can be used for support. Such an apparatus is designed to support a user while standing in the shower or to assist them in getting up from sitting in a bathtub. A handrail can also provide support to those wishing to sit on the edge of a bathtub, but handrails are typically an expensive item that must be installed by someone with particularized knowledge. Additionally, one hand of the user must always be holding onto the handrail or the stabilizing benefit of the handrail is lost, which frustrates the function of performing actions in the bathtub.

Many bathtubs have shower doors permanently installed on the edge of the bathtub. Most shower doors include a lower rail mounted on a top surface of the edge of a bathtub. As such, it is quite painful to sit on the edge of such a bathtub having a lower rail mounted thereon because of the uneven surface caused by the rail.

Embodiments of the invention address these and other limitations of the prior art.

DETAILED DESCRIPTION

Embodiments of the invention include a seat for use around the bathtub area. Specifically, the seat is formed so that it can fit around a side wall of a bathtub. Because there are many standard sizes of bathtubs, some embodiments of the invention include an adjustment mechanism so that the seat can be adjusted to securely attach to the side wall of most sizes of bathtubs. Other embodiments of the invention provide for a seat that can be used within the bathtub itself. Further embodiments are implemented that can sit securely on a bathtub on which a door rail is also attached.

Figure 1:
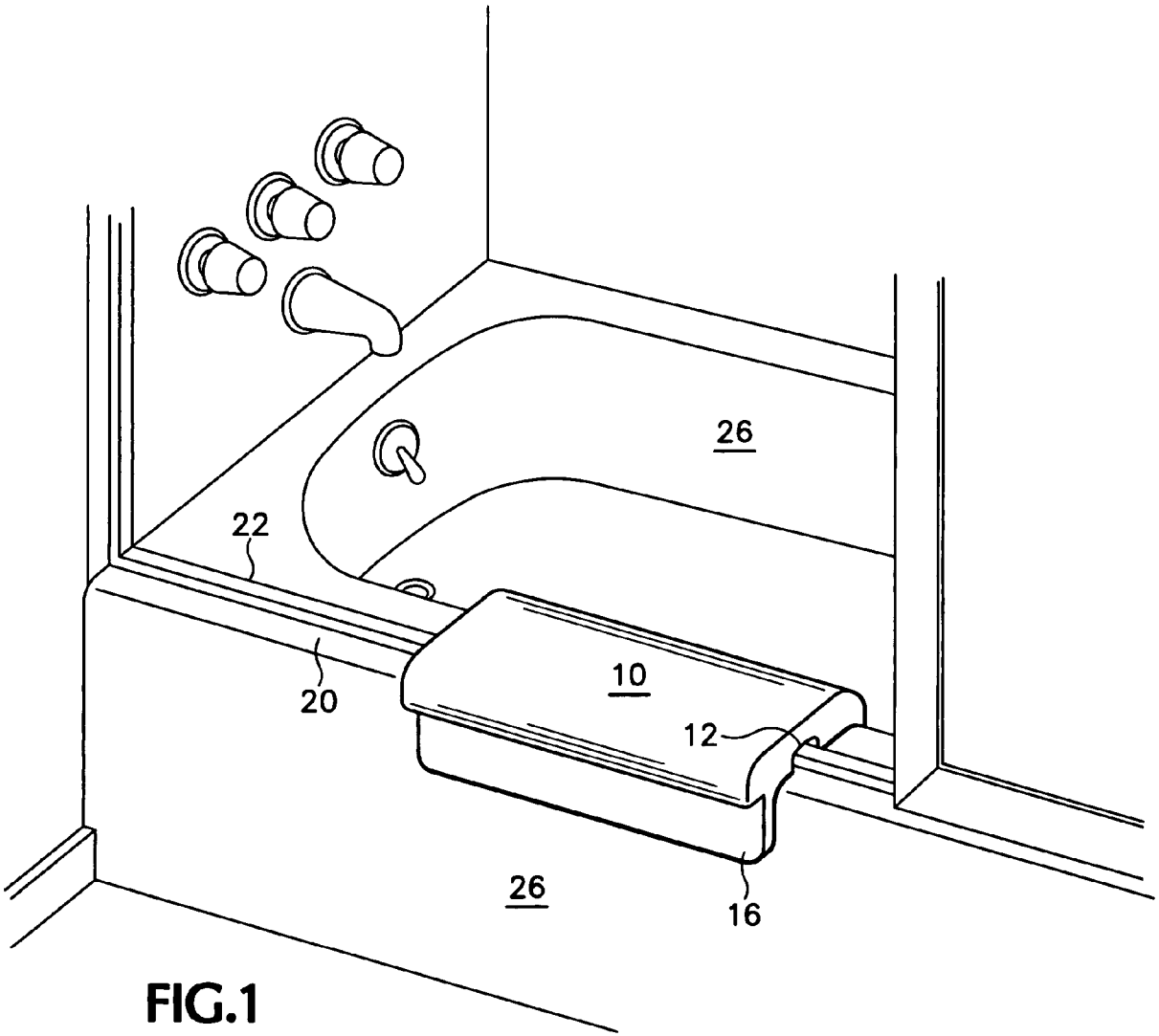
FIG. 1 is a perspective view illustrating a bathroom environment and a bathtub seat according to an embodiment of the invention.

FIG. 1 illustrates an operating environment of a seat 10 according to an embodiment of the invention. As shown in FIG. 1, the seat 10 extends over a sidewall 20 of a bathtub and provides a stable surface on which a person may sit. To accommodate a lower rail 22 of a shower door, a slot 12 can be cut in the underside of the top surface of the seat 10. In this manner, the remaining portions of the underside top surface of the seat can sit down firmly on the edge 20 of the bathtub, and not rock back and forth on the lower rail 22 of the shower door. In this position, users sitting on the seat can put their feet or legs inside the bathtub while seated on the top of one of the side surfaces of the tub.

As shown in FIG. 1, the seat 10 may be formed of a supple, soft material, such as sturdy foam. This provides a comfortable support to sit. Additionally, the same or a different material can extend downward along sides 26 of the bathtub 20 as side extensions 16 to provide a clinging-type force that keeps the seat 10 in position. The seat 10 can be easily moved by simply lifting up on the seat 10 itself. Depending on the amount of force the side extensions 16 exert on the sides 26 of the bathtub, the extensions may 26 be biased outward away from the bathtub before lifting on the seat 10 for removal.

Typically, the seat 10 according to this embodiment would be formed of a durable, waterproof, non-absorbent material able to provide padding for comfort and able to be readily cleaned by normal household products.

In operation, a user slips the seat 10 over the sides 26 of the bathtub, aligning the slot 12 of the seat with the door rail 22, if there is such a door rail. If there is no door rail 22, the seat 10 is simply slipped over the sides 26 of the bathtub. If the distance between the side extensions 16 is appreciably more narrow than the distance between the inside and the outside of the sides 26 of the bathtub, the side extensions 16 may need to be spread or pulled apart such that they can slip over the sides of the bathtub. In such an embodiment, the natural return force of the side extensions can hold the seat in place. In other embodiments, the side extensions 16 may be curved to facilitate the return force. In other words, in the curved embodiments the side extensions 16 (or portions of the side extensions) would be closer to one another farther away from the top surface of the seat 10 than at the top surface itself.

Figure 2:
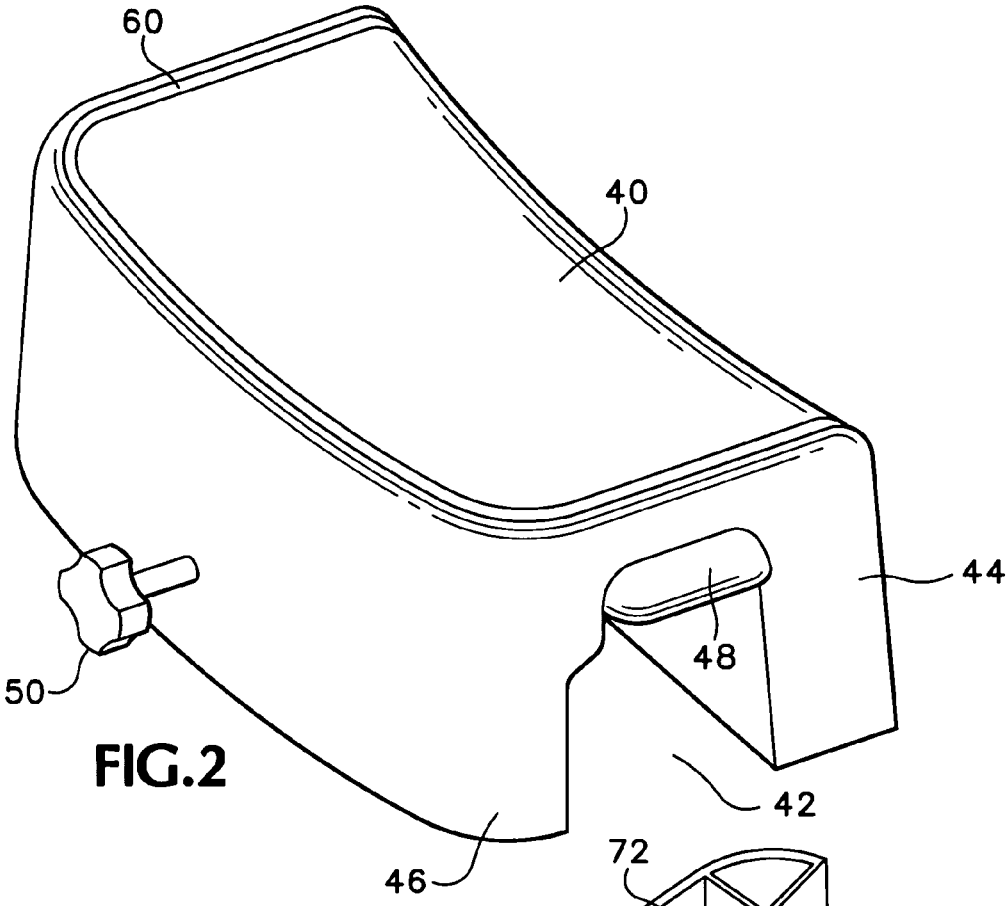
FIG. 2 is a three-dimensional isometric view of a seat according to an embodiment of the invention.

FIG. 2 shows a seat 40 according to another embodiment of the invention. The seat 40 according to this embodiment may be formed of a rigid material, such as a hard plastic that is shaped to accommodate a person while in a sitting position. One main feature of the seat 40 is a notch 42 shaped to accommodate the edge of a bathtub. Additionally illustrated in FIG. 2 is that the notch 42 may have a "stairstep" shape designed to accept a shower door rail.

Thus, when the seat 40 is placed over a bathtub that has a shower rail, the notch 42 does not rest on the rail itself, but rather on the top edge of the bathtub. The distance between the front portion 44 and the rear portion 46 is sized to accommodate several different bathtub shapes. For instance, the distance between the two portions 44, 46 may be as narrow as approximately 2-3 inches or as wide as approximately 5-7 inches, and more preferably between about 3.5-5 inches.

The seat 40 includes a front portion 44 and a rear portion 46. When installed over the sidewall of a bathtub, the front portion 44 is within the tub while the rear portion 46 is outside of the bathtub. Molded or attached handles 48 facilitate lifting, carrying, and moving the seat 40.

In one embodiment, the seat 40 is approximately 15-20 inches wide, and preferably 18 inches, and has a "scooped" shape to comfortably support the bottom of the user. The seat 40 of FIG. 2 also has a groove 60 about the perimeter of the seat. This groove can channel water or other liquid that falls on the seat 40 back into the bathtub.

The seat 40 may be covered with a non-slip surface to minimize movement while in a wet environment, such as a bathroom. Additionally, in other embodiments of the invention (not shown), the edges of the seat can be several inches high. In other words, the "scooped" shape may actually be a depression several inches below a top level of the seat which can help to hold the user in place while using the seat.

A knob 50 is used to secure the seat to a bathtub, as described below.

Figure 3:
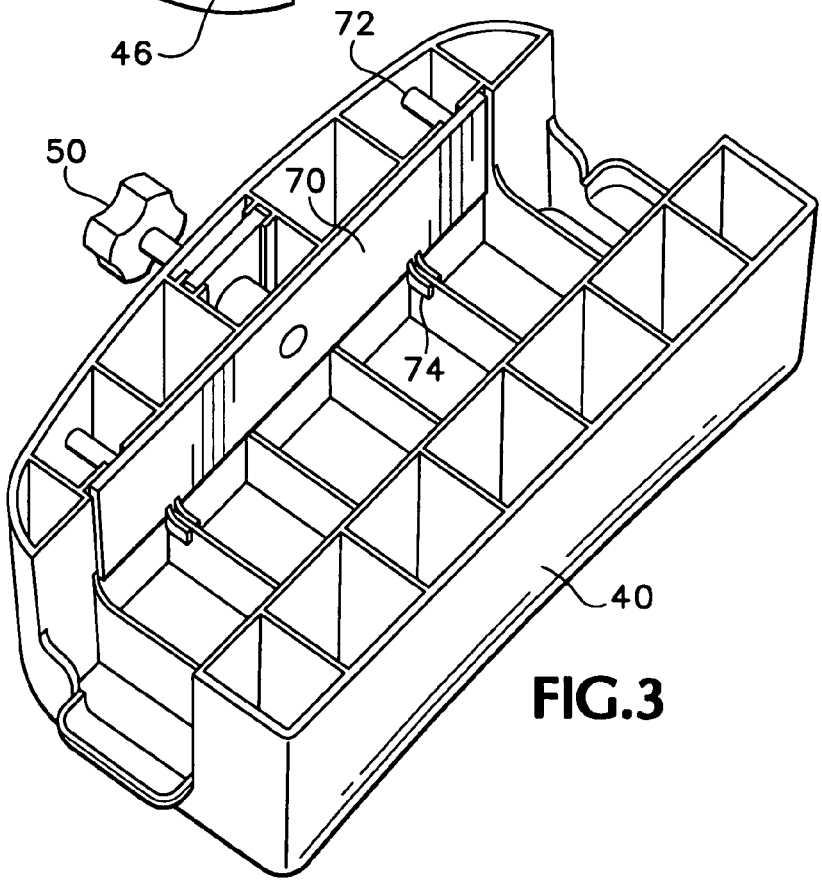
FIG. 3 is a view of the underside of the seat of FIG. 2.

FIG. 3 is a bottom view of the seat 40 shown in FIG. 2. As illustrated, a securing plate 70 is adjustable to provide a frictional clamping force against the side wall of the bathtub. The securing plate 70 can be threaded and adjusted by a threaded bolt coupled to the knob 50. In operation, the user places the seat 40 over the side of the bathtub and turns the knob 50. Turning the knob 50 causes the securing plate 70 to be forced toward the side of the bathtub. Once the securing plate 70 touches the side of the bathtub, additional turning of the knob 50 clamps the seat 40 securely into place. In other uses, the seat need not be placed over the side of a bathtub, but could be used with showers having small lipped edges or with other structures.

With reference to FIG. 3, the securing plate 70 includes guides 74 that ensure the securing plate moves laterally with relation to the seat 40. Additionally, extensions 72 are provided for additional support while the securing plate 70 is being moved.

A bolt-thread arrangement is only one of any number of ways that the securing plate 70 could be clamped to the side of the bathtub. For instance, the securing plate 70 could be clamped by a cam-lever action. In some embodiments, the securing plate 70 is covered with a material that increases its frictional force with the side of a standard bathtub, such as neoprene or other suitable material.

Figure 4:
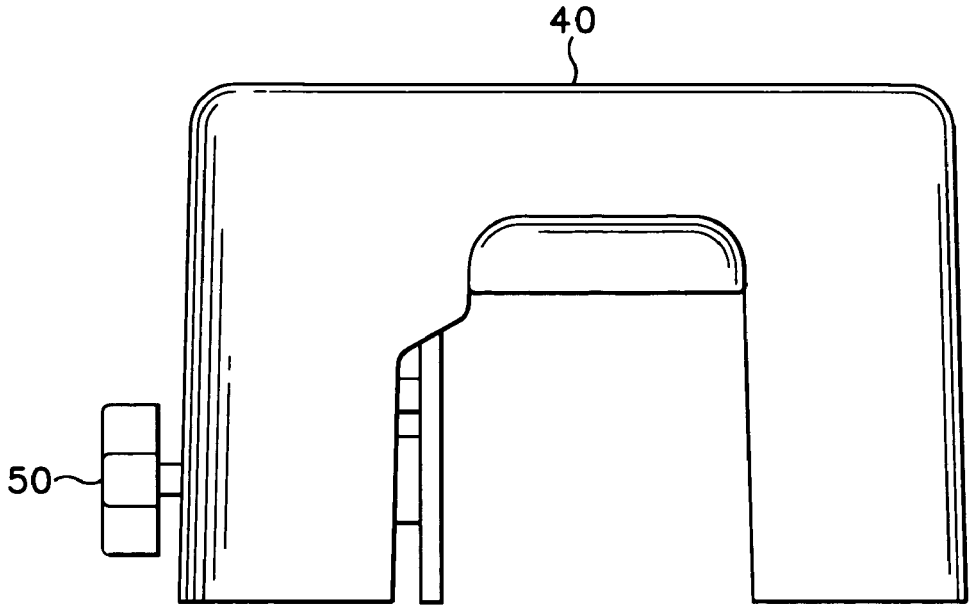
FIG. 4 is a side view of the seat of FIG. 2.

FIG. 4 illustrates the operating position of the seat 40, which, as described above, can be placed over the edge of the bathtub. Because a bottom surface of the seat 40 is relatively flat, however, the seat 40 itself can be placed on any surface where a portable seat is desired, and is not limited to being placed over the side of the bathtub. For instance, the seat 40 may be used inside the bathtub itself, on the bottom surface thereof. In this usage, the seat is placed on the bottom surface of the bathtub. In this manner, the user sits on the seat and is elevated over the level of the water within the bathtub. Thus, the users can stay relatively dry while within a partially filled bathtub. Similarly, the seat 40 can be used as a step, but this use is only recommended if the seat is placed on a non-slippery surface, such as a carpet.

Figure 5:
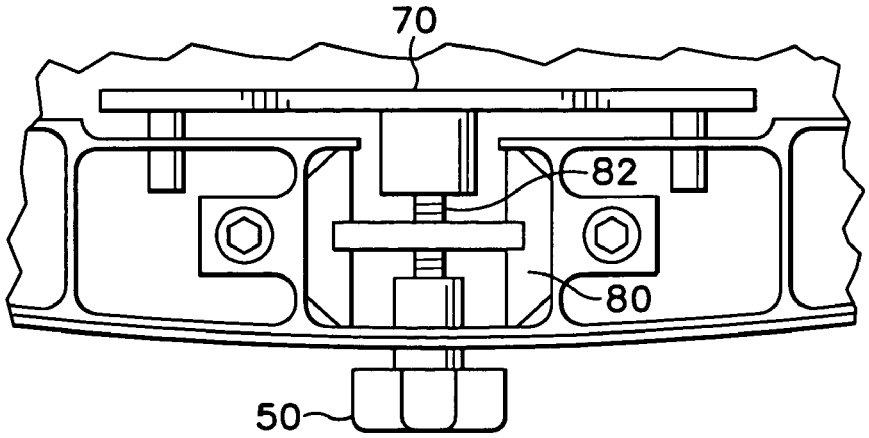
FIG. 5 is a bottom view of an example of an attaching mechanism used in embodiments of the invention.

FIG. 5 is a detailed view of the threading mechanism used in embodiments of the invention. In this view, the securing plate 70 is threadedly coupled to a bolt 82 that is attached to the relatively large knob 50. The bolt 82 is inserted through a threaded plate 80 that is secured to the seat 40. In operation, as the knob 50 is turned, the bolt 82 also turns through the threaded plate 80. Because the threaded plate 80 is stationary, the securing plate 70 is moved laterally as it is displaced by the threads on the bolt 82.

The knob 50 is sized to be easily turned and can be rounded and notched, as shown here, or can take another shape, such as elongated to provide additional leverage.

Figure 6:
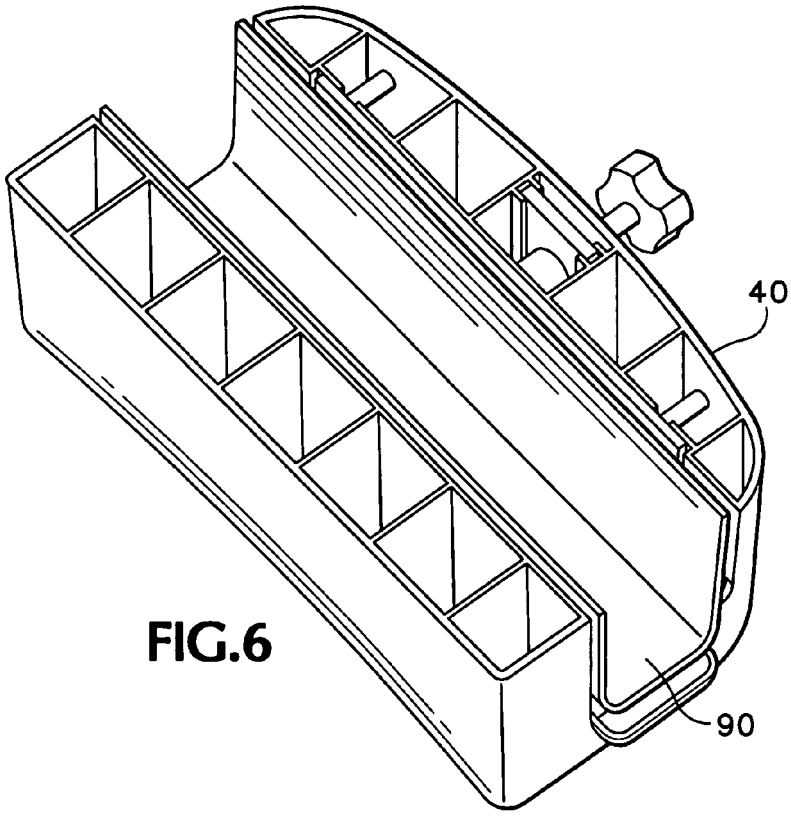
FIG. 6 is a bottom view of a liner that can be used with embodiments of the invention.

FIG. 6 illustrates the inside surface of the notch 42 can be lined with a friction material 90 that increases the frictional force of the securing plate 70. In some embodiments, only the securing plate 70 is lined with the friction material 90. In other embodiments only the securing plate 70 and an opposite side of the notch 42 is lined with the friction material 90. In still other embodiments, the entire inside surface of the notch 42 is lined with the friction material.

Figure 7:
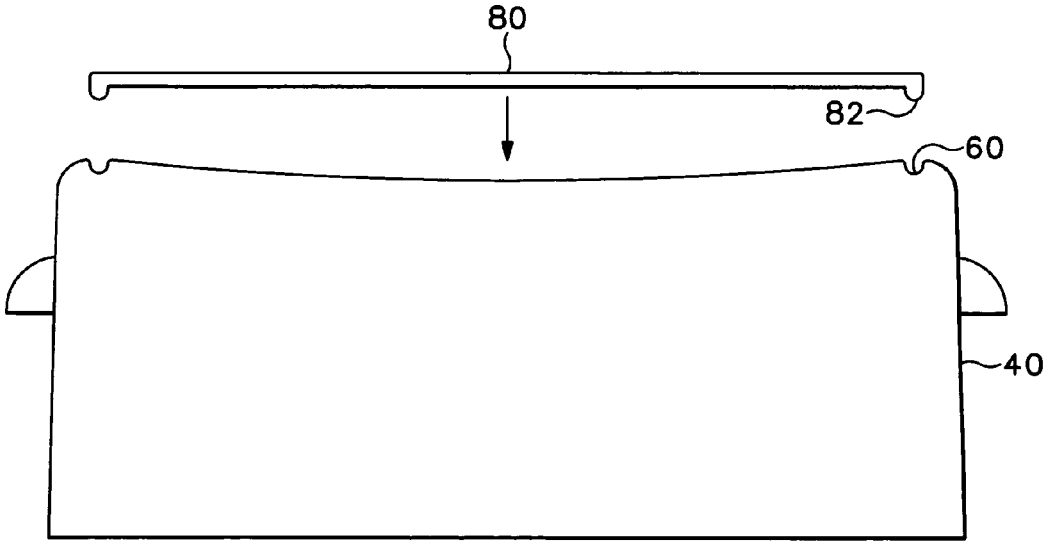
FIG. 7 is a cross-sectional view of the seat of FIG. 2 including a related table top that can be removeably integrated with the seat.

FIG. 7 illustrates another use for the seat 40. In FIG. 7, a tabletop 80 is integrated with and used in conjunction with the seat 40. The tabletop 80 provides a flat surface, as illustrated in FIG. 7 that can support objects placed thereon. A ridge 82 on the tabletop 80 is shaped and sized such that it matches the groove 60 that runs around a portion of the perimeter of the seat 40, as illustrated in FIG. 2.

In operation, the user places the tabletop 80 on the seat 40 such that the ridge 82 mates with the corresponding groove 60. This stabilizes the tabletop 80 and prevents the tabletop from slipping from the seat 40. In application, the ridge 82 may be made from the same or a different material than the tabletop 80 itself. The ridge 82 may be flexible or rigid. The tabletop 80 may be made from the same rigid material as the seat 40, but as the tabletop is not designed to support much weight, the tabletop need not be as sturdy as the seat. Alternatively, the tabletop may be made from a foam or other material.

The tabletop 80 provides a flat surface on which to place objects while the user is bathing in the bathtub. For example, the tabletop 80 may support a book, drinking cup, candle, incense, food, bathing products, or any other object that may be desired by the user. Additionally, the tabletop 80 can provide a surface on which to place objects even when the user is not in the bathtub.

Of course, other embodiments of the invention are possible and are also deemed to be within the spirit and scope of this invention.

What is claimed is:

1. A seat, comprising:

a top sitting surface;

an inside region extending in a first direction away from the top sitting surface and for positioning inside an edge of a bathtub;

an outside region extending in the first direction and for positioning outside an edge of the bathtub;

a notch defined by the inside region, the outside region, and an underside of the top sitting surface, the notch having a stairstep shape to accommodate a rail such that the seat does not rest on the rail, at least one handle disposed above the notch; and a clamp structured to tightly hold the seat against the sidewall of the bathtub, the clamp comprising:

a securing plate, the securing plate including at least two guides configured to ensure the securing plate moves laterally with respect to the bathroom seat and at least two extensions configured to support the securing plate;

a plate fixedly attached to one of the inside and outside regions;

a threaded bolt structured to be inserted through the plate and attached to the securing plate; and a knob coupled to the threaded bolt.

2. The bathroom seat of claim 1, further comprising a non-slip material covering at least a portion of the securing plate.

3. The seat of claim 1 wherein the inside region and the outside region are spaced between approximately 4-8 inches from one another.

4. The seat of claim 1 wherein the inside region extends in the first direction away from the top surface between approximately 6-12 inches.

5. The seat of claim 1, further comprising a friction material covering an entire interior surface of the notch.

6. The seat of claim 1, further comprising a tabletop having a mating surface that interferes with a related surface on the top sitting surface.

7. The bathroom seat of claim 1, wherein the top sitting surface comprises a groove, the groove disposed about a perimeter of the sitting surface and configured to channel a liquid on the top sitting surface toward the inside leg.

* * * * *